United States Patent [19]

Newman

[11] Patent Number: 4,600,030

[45] Date of Patent: Jul. 15, 1986

[54] COSMETIC ARTICLE

[76] Inventor: David M. Newman, 3106 19th St., N.W., Washington, D.C. 20010

[21] Appl. No.: 622,879

[22] Filed: Jun. 21, 1984

[51] Int. Cl.[4] ..... A45D 40/30

[52] U.S. Cl. ..... 132/88.5; 132/73

[58] Field of Search ..... 132/73, 88.5

[56] References Cited

U.S. PATENT DOCUMENTS

| | | | |
|---|---|---|---|
| 2,688,331 | 9/1954 | Bogoslowsky | 132/73 |
| 2,979,061 | 4/1961 | Greenman et al. | 132/73 |
| 4,126,144 | 11/1978 | Dugrte | 132/73 |

OTHER PUBLICATIONS

Cosmetics Science and Technology—Sagarm—1957, pp. 696 and 697.

*Primary Examiner*—Gregory E. McNeill

*Attorney, Agent, or Firm*—Richard C. Litman

[57] ABSTRACT

A cosmetic article comprising an artificial finger nail made of metal foil, said artificial finger nail being attached to a natural finger nail by means of a film of pressure sensitive adhesive, and said artificial finger nail further being removable without the use of solvents and without leaving residue on the wearer's natural finger nail.

2 Claims, No Drawings

COSMETIC ARTICLE

BACKGROUND OF THE INVENTION

Artificial finger nails as a cosmetic article are old in the art and are commonly available in retail establishments where cosmetics are sold. Most of the artificial finger nails found on the market are manufactured from plastic or synthetic resins which require the use of various glues for purposes of attachment and further require the use of solvents to remove the residue of glue from the wearer's natural finger nail. The process of application and removal of the presently available cosmetic article requires the expenditure of time and materials.

This invention makes the application, as well as the removal of the cosmetic article, a very simple matter requiring no additional materials and essentially no expenditure of time.

The present invention employs a novel application of a pressure sensitive adhesive to the cosmetic article which then permits the cosmetic article to be applied and removed with ease.

SUMMARY OF THE INVENTION

A cosmetic article constructed in accordance with the present invention utilizes leaves of metal foil, which are cut in various sizes to resemble human finger nails. The artificial nails, which are initially flat, will conform to the curvature of the normal human finger nail when placed in contact with the wearer's natural nail and subjected to light to moderate finger pressure. The artificial nails remain in place due to a film of pressure-sensitive adhesive which coats a part of the underside of each artificial nail, said adhesive being in the form of a viscoelastic material comprising styrene-butadiene copolymer. The part of the artificial nail coated with the film is of suitable size and shape to effect intimate contact between the underside of the nail and the wearer's natural finger nail. The artificial nails remain in place until the wearer decides to remove them at which time they can simply be peeled away without the use of solvents and without leaving residue on the wearer's natural finger nail. While the artificial nail is in use, its surface is suitable for the application of nail polishes or like decorative materials.

DESCRIPTION OF THE PREFERRED EMBODIMENT

This invention relates to a cosmetic article in the form of an artificial finger nail, which may be worn as a decorative object for evening or formal occasions.

The artificial finger nail is made of a metal foil, preferably aluminum, a material that makes the invention easy to manufacture, economical, and capable of conforming to variable radii of curvature when the nail is applied. The metal article, which is initially flat, will conform to the curvature of the normal human finger nail when the artificial nail is placed in contact with the wearer's natural finger nail and subjected to light to moderate finger pressure. The artificial finger nail remains in place due to a film of pressure-sensitive adhesive which coats a part of the underside of each nail, said adhesive being in the form of a viscoelastic material comprising styrene-butadiene copolymer and other components.

An adhesive which is suitable for the present invention must be dry in a solvent free state at room temperature, and must be permanently tacky and adhere spontaneously to most smooth surfaces on contact or with minimal pressure. No activation by heat or solvent should be required. The adhesive must further be cohesively strong so that upon removal no apparent residue is left on the surface of the natural finger nail.

The preferred substance for this application is obtained as a copolymer of styrene (30%) and butadiene (70%). The complete composition of the adhesive is as follows:

Styrene-butadiene copolymer—50 parts;
Milled block styrene-butadiene rubber—50 parts;
Hydrogenated rosin ester—50 parts;
Polymerized trimethyl dihydroquinoline—2 parts;
Petroleum oil—20 parts.

The desired pressure-sensitive composition is achieved by pre-blending the liquid styrene and styrene-butadiene block rubber in a rubber mill to obtain a meltable mix. The pre-blended mix and liquid butadiene are then introduced together with the other components into a pressure vessel with means for agitating the mix and heating to a temperature of 350 degrees Fahrenheit for a period of time sufficient to produce the copolymer component with a molecular weight in the range of 1500–5000.

The resultant adhesive compound is then applied as a hot melt to the underside of the artificial finger nail in an area of suitable size and shape to effect intimate contact between the underside of the artificial nail and the wearer's natural finger nail.

The artificial nail is used by placing it in contact with the natural nail and applying light to moderate finger pressure, causing the artificial nail to conform to the shape of the wearer's natural nail. The artificial nail remains in place until the wearer decides to remove it, at which time the artificial finger nails can simply be peeled away without the use of solvents and without leaving residue on the wearer's natural fingernail. While the artificial nail is in use, it can be decorated by the application of nail polishes or like materials.

I claim:

1. A cosmetic article comprising:

an artificial finger nail made of a metal foil, said artificial finger nail having a coating consisting of a film of pressure sensitive hot melt adhesive, said adhesive consisting essentially of a mixture of styrene-butadiene copolymer, milled block styrene-butadiene rubber, hydrogenated rosin ester, polymerized trimethyl dihydroquinoline, and petroleum oil.

2. A cosmetic article as recited in claim 1 in which the artificial nail may be removed by peeling said artificial nail away from the natural nail without the use of solvents and without leaving residue on the wearer's natural finger nail.

* * * * *